United States Patent [19]

Braman

[11] Patent Number: 4,971,089

[45] Date of Patent: Nov. 20, 1990

[54] FOLDING SHELTER

[76] Inventor: Bruce W. Braman, 8723 Jenks Rd., Belding, Mich. 48009

[21] Appl. No.: 288,488

[22] Filed: Dec. 22, 1988

[51] Int. Cl.[5] ..... A47C 7/62

[52] U.S. Cl. ..... 135/90; 135/96; 182/200; 248/188.9; 297/184

[58] Field of Search ..... 135/90, 96, 901, 900; 297/184; 248/188.9; 182/200, 201

[56] References Cited

U.S. PATENT DOCUMENTS

| | | | |
|---|---|---|---|
| 722,883 | 3/1903 | Palmer | 135/90 |
| 744,487 | 11/1903 | Childress | 135/90 |
| 1,443,921 | 1/1923 | Mackenzie | 135/96 |
| 1,812,119 | 6/1931 | Ruse | 182/200 |
| 1,909,620 | 5/1933 | Lang | 248/188.9 |
| 2,137,427 | 11/1938 | Thomson | 135/96 |
| 2,184,486 | 12/1939 | Chew | 182/200 |
| 2,277,939 | 3/1942 | Thalhammer | 248/188.9 |
| 2,409,622 | 10/1946 | Gottfried | 248/188.9 |
| 2,423,659 | 7/1947 | Rabe | 248/188.9 |
| 4,093,305 | 6/1978 | Staroste | 297/184 |

FOREIGN PATENT DOCUMENTS

| | | | |
|---|---|---|---|
| 694383 | 1/1931 | France | 135/96 |
| 6394 | of 1895 | United Kingdom | 135/96 |

*Primary Examiner*—Henry E. Raduazo

*Attorney, Agent, or Firm*—Waters, Morse & Harrington

[57] ABSTRACT

This folding shelter has a canopy that can be attached to a folding chair, and removed easily for portability. Struts engaging the back structure of the chair support the canopy under a degree of tension. The canopy has a top panel and depending side and back panels, the latter being detachably secured to the back structure of the chair. Preferably, retractable bearing plates are provided at the lower extremities of the legs of the chair. An optional skirt panel is also provided extending around at least three sides of the chair, and attachable to the side and back panels, with auxiliary support extending from the chair to position the lower rear extremities of the skirt panel.

15 Claims, 3 Drawing Sheets

FOLDING SHELTER

BACKGROUND OF THE INVENTION

The techniques of hunting wild game often involve the use of some form of concealment, or blind. These are either constructed at some promising site, or are portable devices capable of being collapsed into more or less compact condition for transport. Folding chairs are often a part of a hunter's equipment, the trouble of carrying them being justified by the avoidance of sitting on cold or damp ground. Some attempts have been made to provide a shelter along with the blind or chair, primarily as a protection against rain. A practical combination of these three functions is apparently not presently available with reasonable portability. It would have wide appeal to those interested in hunting deer, waterfowl, turkeys, and any other game when the hunter can select a position where there is a reasonable expectation that the game will come within range. Such a device would also be useful as a shelter and windbreak in ice fishing.

SUMMARY OF THE INVENTION

This shelter has a set of components that attach to a folding chair of the type that provides a substantial back support, preferably one that has vertical back rails that provide legs and extend at least to shoulder height of an occupant of the chair. Vertically spaced struts extend from the upper portion of the back rails on both sides of the chair to support a canopy, the struts having a cantilever engagement with the rails permitting the struts to generate tension in the canopy between the outer ends of the struts. The canopy preferably has a top panel and depending side and back panels, the latter being detachably secured to the back structure of the chair. The spacing of the struts on each side is variable to establish the attitude of the canopy. The chair is also provided with retractable bearing plates for the support of the chair on soft ground.

DESCRIPTION OF THE PREFERRED EMBODIMENT

Figure 1:
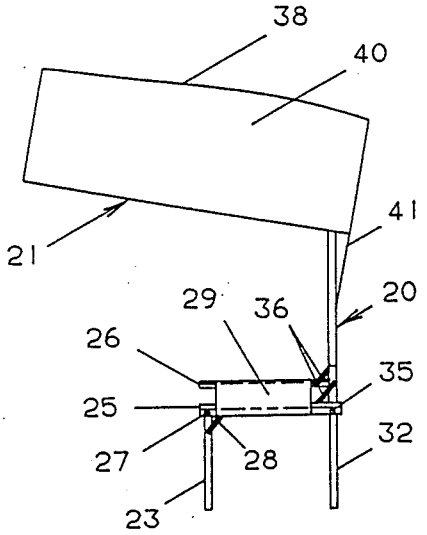
FIG. 1 is a side elevation of the chair with the canopy attached in the upwardly-inclined position.
Figure 2:
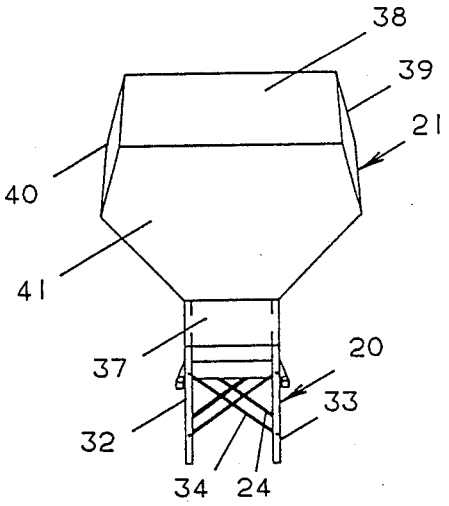
FIG. 2 is a rear elevation of the chair illustrated in FIG. 1.
Figure 16:
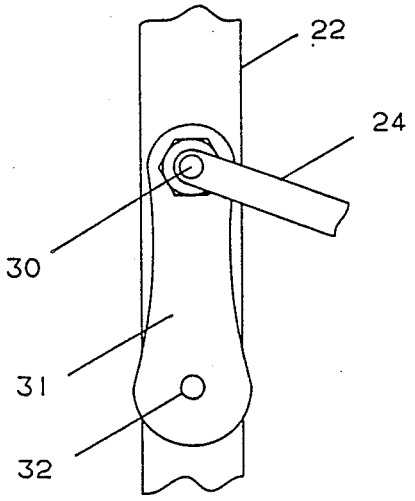
FIG. 16 is a view showing the arrangement for holding the ends of the X braces that stabilize the folding chair.

Referring to the drawings, the shelter includes the folding chair generally indicated at 20 and the reinforced fabric canopy 21. The chair has the front legs 22 and 23, stabilized by the front X brace 24. The front legs are pivoted to the seat rails 25 and 26 as shown at 27 in FIG. 1. The angular relationship between the legs and the seat rails is releasably fixed by the short diagonals 28 in an arrangement familiar in the construction of card tables. The fabric seat 29 extends between the side rails 25 and 26, and is either secured with fastenings, or receives the rails in an elongated sleeve. The upper extremities of the X brace 24 are secured in the arrangement shown in FIG. 16. The crossed arms of the brace are pivoted at their intersection, in their usual manner, with the lower extremities pivotably secured to the legs 22 and 23. The upper extremities are releasably secured by being received over the studs 30 on the front legs, and are held in place by the flexible plastic tabs 31 provided with holes 32 which can be pressed down over the studs 30 in a forced fit after the ends of the X brace are in engagement as shown in FIG. 16. When engaged, the X brace maintains the parallelism and spacing of the front legs. When disengaged from the studs 30, the X brace is capable of collapsing so that the front legs can be brought together in the usual folding arrangement.

The rear legs of the chair are provided by the rails 32 and 33 which extend upward above the seat 29 to form the back supports. These rails are maintained in parallelism by the rear X brace 34. The rails 32 and 33 are pivotably connected to the seat rails 26 and 27 as shown at 35 in FIG. 1. The angular relationship between the rails 32 and 33 and the seat rails is controlled by the short disengageable diagonals 36 functioning in the same manner as the diagonals 28. The chair is easily folded into an elongated compact configuration. The upper ends of the rear X brace are disengageable in the same manner as the front X brace, and the sides of the chair can then be brought together. The front legs can then be rotated counter-clockwise, as viewed in FIG. 1, until they approach parallelism with the seat rails, after which the diagonals 36 can be disengaged to permit the seat and legs to be rotated together clockwise into parallelism with the rear rails 32 and 33. The fabric seat 29 and the fabric back 37 collapse along with the framework of the chair.

Figure 3:
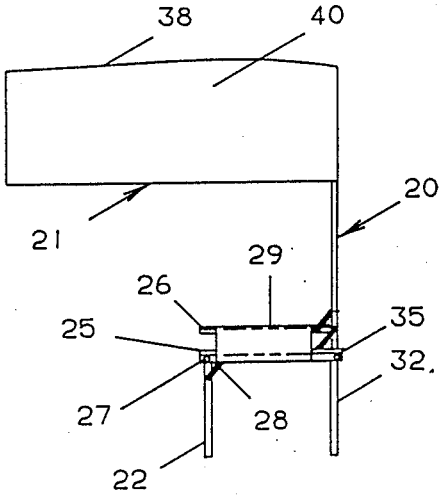
FIG. 3 is a side elevation showing the chair with the canopy in a horizontal position.
Figure 8:
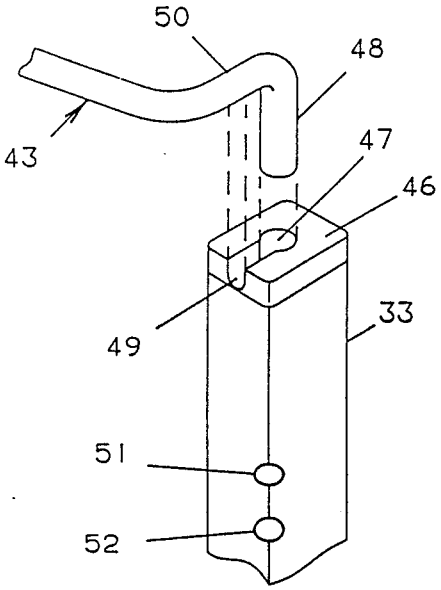
FIG. 8 is a fragmentary view in perspective of the top of the back support, showing the configuration for receiving the supporting struts for the canopy.

The canopy 21 includes the top panel 38, the depending side panels 39 and 40, and the back panel 41 integral with the side panels. The canopy is supported by the upper struts 42 and 43, together with the lower struts 44 and 45. The upper extremities of the rear rails 32 and 33 are formed as shown in FIG. 8 to receive the inner ends of the upper struts. The rails themselves are preferably of hard wood, and may be provided with caps of a durable plastic material as shown at 46. These caps are adhesively bonded to the end of the wooden rails. A central axial opening 47 traverses the caps 46, and extends into the wood to receive the downturned portions 48 of the offset ends of the upper struts. The length of this interengagement is preferably at least an inch and a half (1½") to two inches (2"), enough to permit this interengagement to resist a considerable amount of bending moment. A lateral groove 49 in the cap 46 receives the portion 50 of the strut, this interengagement preventing relative rotation of the strut with respect to the rails about the axis of the rails. The combination of these two interengagements permits the upper struts to be substantially responsible for the support of the canopy. The lower struts 44 and 45 can be selectively engaged with either of the lower apertures 51 or 52, which are positioned to establish a considerable downward pull on the side panels 39 and 40 in order to maintain a degree of tension in the fabric canopy. Preferably, one of the recesses 51 and 52 is machined into the rails at a different angle from the other, so that a selection between the two can establish a different degree of downward pull on the fabric, and correspondingly select the difference between the inclined canopy position shown in FIG. 1, and the horizontal position of FIG. 3. The recesses 51 and 52 can be lined with a metal or plastic tubing (not shown) in order to increase the durability of the arrangement.

Figure 9:
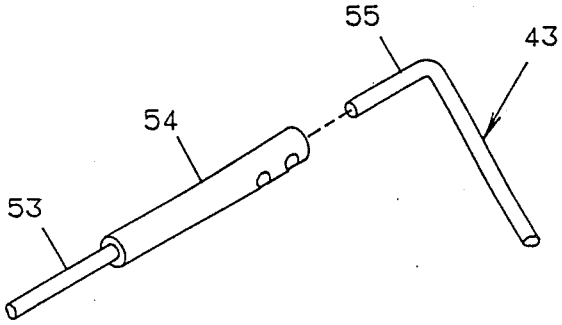
FIG. 9 is a fragmentary view in perspective showing the coupling of a support rod with the upper marginal canopy rod.
Figure 10:
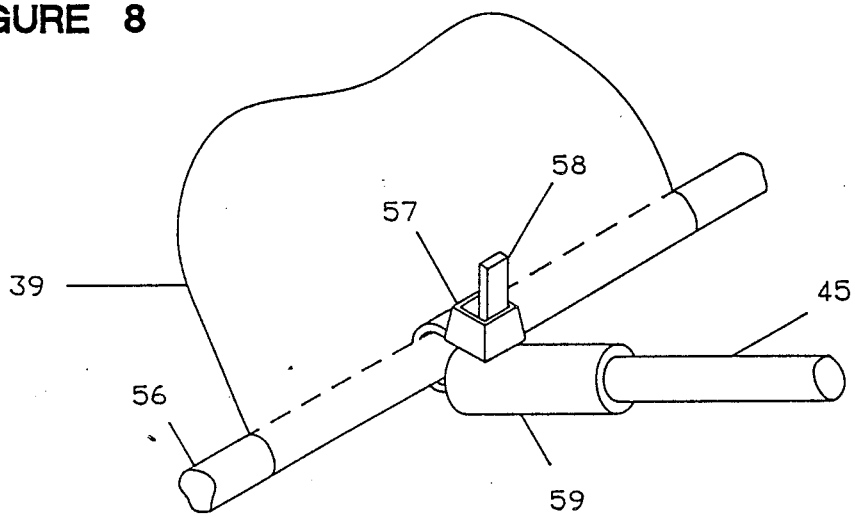
FIG. 10 is a fragmentary perspective view showing the coupling of a lower strut to the intermediate portion of the lower marginal canopy rod.
Figure 11:
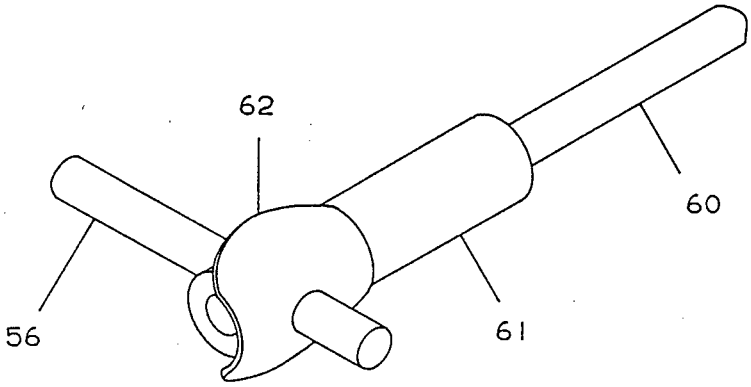
FIG. 11 is a fragmentary perspective view showing the coupling of the stretcher rod to the front end of the upper marginal canopy rod.

The canopy has marginal rods at the intersection of the top and side panels, and these are preferably received in sleeves (not shown) sewn along this junction. One of these rods is indicated at 53 in FIG. 9, and emerges from the sleeve to expose the coupling 54 receiving the outer offset end 55 of the upper struts. The fit of the tubular coupling 54 around the rods 53 and the ends 55 should be a fairly tight fit, as considerable bending moment is transferred between the rods and the struts at this point. The coupling may be of metal or a sufficiently tough plastic material to withstand such stresses. The upper struts 42 and 43 are preferably substantially stiffer than the lower struts 44 and 45. The lower struts are connected to marging rods at the lower edges of the side panels 39 and 40, as shown in FIG. 10. One of these rods is indicated at 56, and the lower struts are interengaged at an intermediate point along these rods to establish the downward biasing action previously referred to for establishing tension in the side panels of the canopy. A standard plastic connector 57 having a configuration similar to that of a hose clamp has a tab 58 that is worked through the fabric of the side panels, around the rod 56, and traverses the end of the coupling 59 tightly received over the outer ends of the lower struts 44 and 45. Tension is similarly maintained in the top panel by the presence of the stretcher rod 60 extending opposite the front edge of the panel, and having couplings as shown at 61 in FIG. 11 that are intersected by the upper marginal rods, and are held in engagement by the plastic pieces 62 having a forced fit over the ends of the margin rods. This construction is provided on both sides of the canopy.

Figure 4:
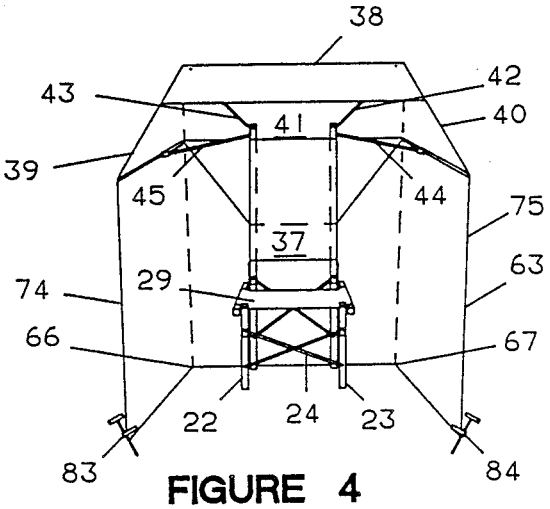
FIG. 4 is a view from the front, showing the chair, canopy, and a skirt panel extending from the canopy to the ground on three sides of the chair.
Figure 5:
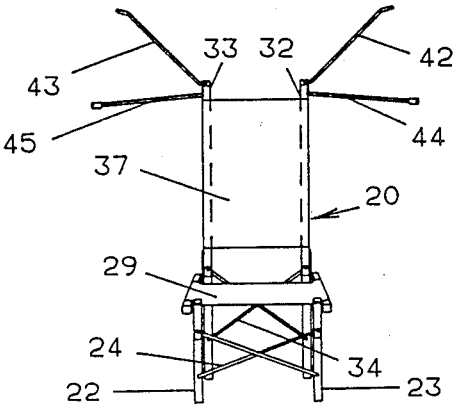
FIG. 5 is a view from the front, showing the chair and the cantilever rods for supporting the canopy.
Figure 6:
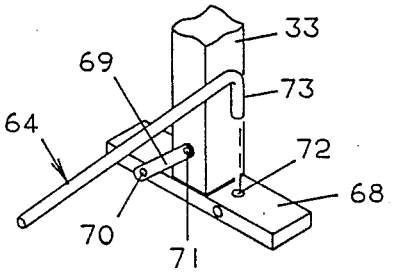
FIG. 6 is a fragmentary perspective view showing a retractable bearing plate at the lower extremity of the rear leg of the chair, and showing the engagement of a lateral strut for positioning the lower portion of the skirt panel.
Figure 7:
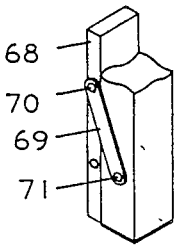
FIG. 7 illustrates the folded, or retracted, position of the bearing plate illustrated in FIG. 6.
Figure 12:
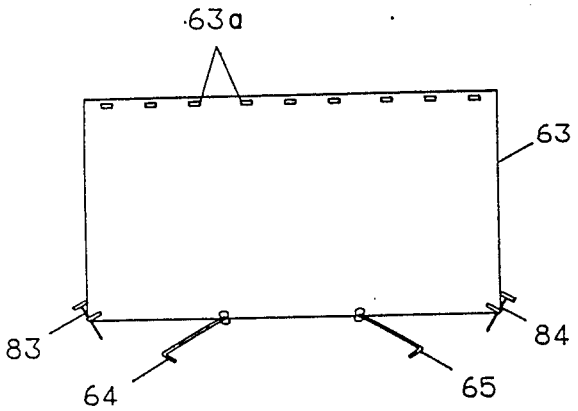
FIG. 12 is a plan view showing the skirt canopy laid out flat, with the attached lower struts and the upper Velcro areas.

When the shelter is used for ice fishing, or a for a hunting blind where concealment from the rear is of primary importance, the arrangement shown in FIG. 4 is used. A skirt panel 63 extends around the sides and back to form an enclosure around the chair 20, with the upper edge of the panel 63 being secured to the side and back panels by appropriately placed Velcro patches **63*a* shown in FIG. 12. The back panel 41 is preferably secured to the back structure of the chair by appropriately placed Velcro patches (not shown). In addition to these, the lower extremity of the skirt panel at the junction of the side and back portions, has struts as shown at 64 and 65 extending to the lower rear portion of the chair to position this portion of the canopy. Preferably, the outer extremities of these lower struts are permanently connected to the skirt panel as shown in FIG. 12, and the inner ends are secured to the chair as shown in FIG. 6. The chair is shown here provided with retractable bearing plates 68 which are very useful when the shelter is to be used on soft ground. Links as shown at 69 are provided at opposite sides of the plates 68, and are pivotably connected to the plates as shown at 70. These are also pivotably connected to the lower extremities of the rear rails as shown at 71, permitting the plates to be swung from the extended position shown at FIG. 6 to the retracted position in FIG. 7. The tops of the plates 68 are provided with holes 72 for receiving the downturned ends 73 of the lower struts 64 and 65**.

Figure 14:
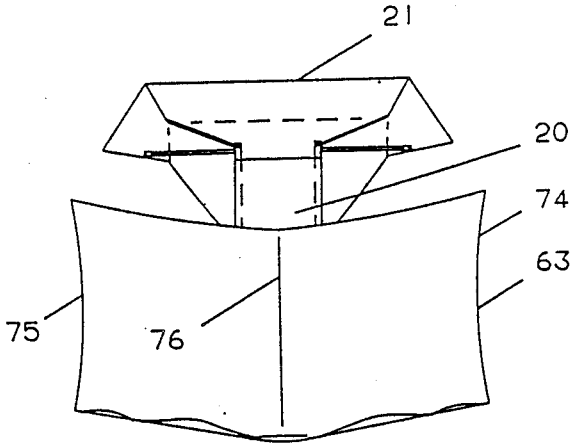
FIG. 14 shows a front view of the chair and canopy, with the skirt canopy arranged to provide a frontal concealment.
Figure 15:
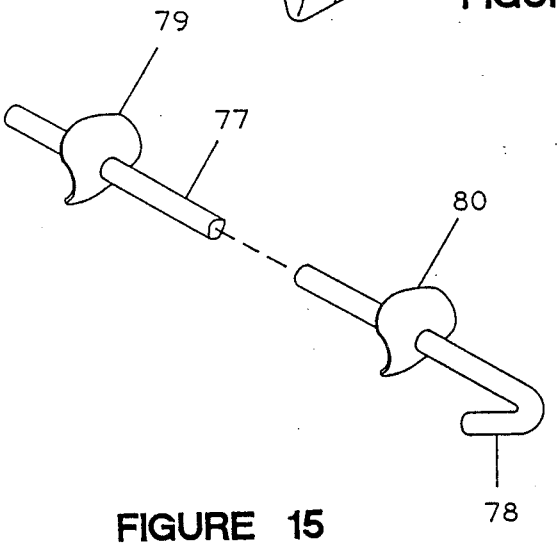
FIG. 15 is a view in perspective showing the preferred form of one of the rod stakes used for holding the skirt canopy in the FIG. 14 position.

When concealment is desired from directions in front of the chair, the arrangement shown in FIG. 14 is used. Here, stake rods having the shape illustrated in FIG. 15 are inserted in the ground along the ends 74 and 75 of the panel 63, and at the middle indicated at 76 to form the apex of a triangular configuration. These rods may either be inserted in sleeves (not shown) sewn along the edges 74 and 75, or through loops (not shown) along these edges at convenient positions. These stake rods 77 preferably have hooked ends 78 to prevent the rods from sliding out of engagement with whatever edge configuration is provided along the ends of the skirt panel. Plastic washer-shaped pieces as shown at 79 and 80 are preferably received over the rods in a forced fit, and may be appropriately positioned to prevent the skirt panel from slipping downward along the rods. It should be noted that the FIG. 14 position of the skirt is considerably lower than that shown in FIG. 4. It is thus to be expected that some of the fabric will accumulate along the ground. As an alternative to the FIG. 14 arrangement, the panel 63 may be extended in length at a reduced height sufficiently to provide a portion extending across the front, in the FIG. 4 arrangement. This frontal concealment panel can also be a separate piece, secured with Velcro or otherwise. Pulling apart whatever securing means is provided will permit this frontal portion to function as a gate, if desired.

Figure 13:
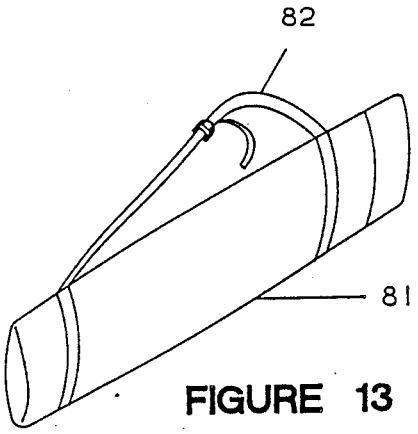
FIG. 13 shows a carrying case in perspective, which accommodates all of the components of the folding shelter.

The rather large area of the canopy and the skirt panel presents something of a problem where wind velocities are significant. Such conditions may require that stakes be driven in the ground around the chair, and auxiliary tiedown lines attached. Small stakes as shown at 83 and 84 in FIG. 4 are preferably secured to the lower edge of the skirt panel at the front. These are pushed into the ground to prevent excessive movement of the panel and canopy. Such equipment is easily included in the collection of the components of the shelter which are collapsible and insertable in a case similar to that shown at 81 in FIG. 13. The case is of any convenient fabric material, and is preferably provided with an adjustable shoulder strap 82. In the preferred proportions of the shelter, this case can be about the size of a golf bag, but slightly longer.

I claim:

1. A folding shelter including a chair having opposite sides and a back structure, and a canopy positioned above said chair, wherein the improvement comprises:

upper and lower spaced strut means extending from and having a connection to said back structure and to said canopy on each of the opposite sides of said chair, each of said strut means being connected to the back of said chair at a single point spaced from the point of connection of the other of said strut means to said back, said connections being capable of transferring bending moment.

2. A shelter as defined in claim 1, wherein said lower strut means are relatively resilient members attached to said canopy at points spaced from said upper strut means, and said strut means are adapted to establish tension in said canopy between said spaced points.

3. A shelter as defined in claim 2, wherein said lower strut means are engageable with said back structure at a plurality of vertically spaced points to selectively position said canopy at various attitudes.

4. A shelter as defined in claim 2, wherein said canopy includes a top panel and depending side panels joined thereto at junctions, and has opposite upper stiffening rods defining said junctions of said top and side panels, said upper strut means being connected to said upperstiffening rods.

5. A shelter as defined in claim 4, wherein said canopy includes axial coupling means receiving the ends of said upper strut means and upper stiffening rods.

6. A shelter as defined in claim 4, wherein said canopy includes lower stiffening rods defining lower edges of said side panels, and said lower strut means is connected to said lower stiffening rods.

7. A shelter as defined in claim 1, wherein said back structure includes opposite substantially vertical side rails each having an axial recess in the upper end thereof, and a radial groove extending from said recesses, respectively, said upper strut means each having an offset end provided with a configuration adapted to engage said recesses and grooves.

8. A shelter as defined in claim 7, wherein said rails have lateral recesses receiving the ends of said lower strut means below said upper strut means.

9. A shelter as defined in claim 1, wherein said canopy has a back panel attachable to said chair at a position below the upper extremity of said back structure.

10. A shelter as defined in claim 9, wherein said canopy has a top panel and depending side panels, and said back panel is integral with said side panels.

11. A shelter as defined in claim 9, wherein said chair has a seat and spaced substantially vertical rails forming a back support, said back panel is removably secured to said rails adjacent said seat.

12. A shelter as defined in claim 9, wherein said shelter includes a skirt panel surrounding at least three sides of said chair, said skirt panel being detachably secured to said back panel and side panels, and further including skirt strut means extending laterally from said chair to said skirt panel at the bottom thereof.

13. A shelter as defined in claim 1, wherein said upper strut means is relatively stiffer in bending than is said lower strut means.

14. A shelter as defined in claim 12, additionally including ground anchor means adapted to secure said skirt panel at the lower front thereof.

15. In combination with a chair having legs, bearing means for supporting said chair on soft ground, comprising:

a plate, and elongated link means pivotally connected at each of the opposite ends thereof to said plate and to at least one of said legs, respectively, said link means being adapted to position said plate alternatively across the end of said leg, or adjacent said leg above said end.

* * * * *